United States Patent [19]

Gravelle

[11] 4,093,401

[45] June 6, 1978

[54] COMPRESSOR IMPELLER AND METHOD OF MANUFACTURE

[75] Inventor: Homer E. Gravelle, Arvada, Colo.

[73] Assignee: Sundstrand Corporation, Rockford, Ill.

[21] Appl. No.: 676,264

[22] Filed: Apr. 12, 1976

[51] Int. Cl.[2] ..... F04D 17/10

[52] U.S. Cl. ..... 416/185; 416/188; 415/143

[58] Field of Search ..... 416/183, 188, 185; 415/143

[56] References Cited

U.S. PATENT DOCUMENTS

| | | | |
|---|---|---|---|
| 1,959,703 | 5/1934 | Birmann | 416/183 |
| 2,422,615 | 6/1947 | Halford | 416/188 |
| 2,484,554 | 10/1949 | Concordia et al. | 416/188 |
| 2,835,960 | 5/1958 | Rork | 29/156.8 |
| 2,965,287 | 12/1960 | Schug | 416/188 |
| 2,985,952 | 5/1961 | Nutter et al. | 29/156.8 CF |
| 3,028,140 | 4/1962 | Lage | 416/188 |
| 3,069,072 | 12/1962 | Birmann | 416/183 X |
| 3,363,832 | 1/1968 | Groff | 415/215 X |
| 3,904,308 | 9/1975 | Ribaud | 416/188 X |
| 3,951,611 | 4/1976 | Morrill | 29/190 |

FOREIGN PATENT DOCUMENTS

| | | | |
|---|---|---|---|
| 2,243 | 3/1969 | Japan | 416/188 |
| 162,667 | 3/1958 | Sweden | 416/DIG. 2 |
| 165,038 | 9/1964 | U.S.S.R. | 416/DIG. 2 |

*Primary Examiner*—Everette A. Powell, Jr.
*Attorney, Agent, or Firm*—Ted E. Killingsworth; William R. Peoples; Michael B. McMurry

[57] ABSTRACT

An impeller blank for a centrifugal compressor has impeller blades with inducer sections of parabolic contour extending in a generally axial direction from generally radial sections of the blades. The angle of the working surface of each inducer section with respect to a plane at right angles to the impeller axis varies inversely with diameter and with the axial dimension of the inducer section from the radial section. The inducer sections are cut to a diameter for minimum gas velocity with respect to the impeller, a function of gas flow rate and impeller speed, and are cut axially for an inlet angle which is a function of the ratio of axial to peripheral gas velocity to achieve flow nearly parallel with the working surface of the inducer section.

22 Claims, 7 Drawing Figures

COMPRESSOR IMPELLER AND METHOD OF MANUFACTURE

BACKGROUND OF THE INVENTION

The present invention generally relates to an impeller of the type used in a device such as a centrifugal compressor. More particularly, the invention relates to the configuration of the blades of the impeller which work on the gas supplied to the inlet or eye of the impeller as the latter is rotated to effect a change in the pressure and flow rate of the gas. In the operation of a centrifugal compressor of this type, the gas enters the eye of the impeller in an axial direction and follows passages defined between the blades of the impeller and a fixed casing located adjacent the impeller so as to be turned to flow outwardly in a generally radial direction and exit at the periphery of the impeller at an increased pressure or head. For efficient operation of the compressor, the flow of gas through the passages should be smooth and continuous with the passages being shaped so that turning and acceleration of the gas are as gentle as possible. Depending upon the operating speed of the impeller and the difference in the inlet and outlet pressures of the gas flowing through the passages, it may be desirable to provide the impeller with an inducer section so as to assure proper flow of gas through the impeller. Such as inducer section usually is in the form of one or more blades rotatable about the same axis as the impeller with the inducer blade or blades being wound in a generally helic-like fashion concentric with the axis. As its leading edge, the working surface of the inducer forms an acute included angle or inlet angle with respect to a plane transverse to the flow of gas. In this way, as the inducer is rotated, it helps direct the gas axially into the impeller for efficient operation of the impeller. While the inducer blades may be separate from the impeller blades, such as is shown in U.S. Pat. No. 3,299,821, on the other hand, the inlet end portions of the impeller blades may be curved in a generally axial direction to provide the inducer function such as is shown in Canadian Patent No. 212,667. The general construction of the exemplary form of the present invention is of this latter type.

In the design of an impeller having blades configured to provide both the inducer function and the usual pressure increasing function, typically, the speed of rotation of the impeller for maximum efficiency is selected for the desired output flow capacity of the compressor and the desired increase in pressure or head of the gas. This speed selection is based on theoretical and empirical considerations known in the art and outside the scope of the present invention. With speed set, the inlet eye diameter of the impeller and the inlet angle of the inducer sections of the impeller blades are determined for maximum efficiency under the operating conditions of the compressor.

Because the impeller speed, eye diameter and inducer inlet angle vary for different operating conditions, rigorous adherance to the principles of established technology would require an impeller peculiar to each set of operating conditions in order to maintain optimum efficiency. However, for basic compressor units capable of operation within a range of capabilities, it is common to use impellers which approximate the optimum geometry with a resulting sacrifice in efficiency to reduce cost. Even by doing this, several impeller patterns are required for a family of compressor capable of operation over a wide range.

SUMMARY OF THE INVENTION

The general object of the present invention is to provide a universal impeller blank which may be easily trimmed specifically for use within any one of the family of compressors without any effective loss of the operating efficiency of the compressor, thereby avoiding the need of a separately designed impeller blank for each of the compressors in the family in order to reach a comparable degree of efficiency. A further object is to achieve the foregoing through the provision of an impeller blank having blades with inducer sections of novel shape enabling the blank to be trimmed in both radial and axial directions in a simple machining operation so as to produce an impeller with blades having the peculiar size, shape and inlet angle desired for efficient operation in a particular compressor of the family, the inlet angle being such as to provide for minimum gas velocity relative to the working surface of the inducer sections of the impeller blades.

A more specific object is to construct the inducer sections of the impeller blades so that the working surface for each section is generated by a family of curves whereby, as the blade is trimmed axially in a plane transverse to the axis of the impeller, the inlet angle varies as an inverse function of its radial distance from the impeller axis and also varies an inverse function of the axial distance of the plane from the merging of the inducer section into a generally radial section of the impeller blade.

A still further object is to generate the working surfaces of the inducer sections of the blades with the aforementioned family of curves by wrapping the curves on cylindrical surfaces oriented concentric with the axis of the impeller so that each curve in the family extends lengthwise in a generally axial direction relative to the impeller whereby a tangent line to the curve at the point of intersection of the curve with the transverse plane generally defines the inlet angle of the inducer section at that point. Advantageously, the curves are chosen according to the general formula, $W = Kf(Z)$, where, W represents the length of wrap of a curve as measured circumferentially on its associated cylindrical surface; Z represents the length of the curve as measured in an axial direction on the same cylindrical surface and, K represents a constant whose value is a tangent function related to the minimum eye diameter which may be cut on the blank for the family of compressors. For different curves in the family, the value of K also is varied according to a ratio of the minimum eye daimeter to an eye diameter selected for the particular impeller being cut. More particularly, it is desirable to form the family of curves to be parabolic curves defined by the formula, $W = KZ^2$, with each curve in the family being tangent to a line extending in an axial direction on the surface of its associated cylinder and with the origins of all the curves in the family lying on a common, generally radial line from the impeller axis.

The invention also resides in the novel method of making the impeller from a blank of the foregoing general character by cutting the inducer sections of the impeller blades to a selected eye diameter established by the operating speed and flow rate for a particular compressor in the family and further by cutting the blades axially to a length so that the inlet angle at the leading edges of the blades is optimum for the eye diameter selected.

These and other objects and advantages of the present invention will become more apparent from the following detailed description when taken in conjunction with the accompanying drawings.

DETAILED DESCRIPTION OF THE PREFERRED EMBODIMENTS

Figure 1:
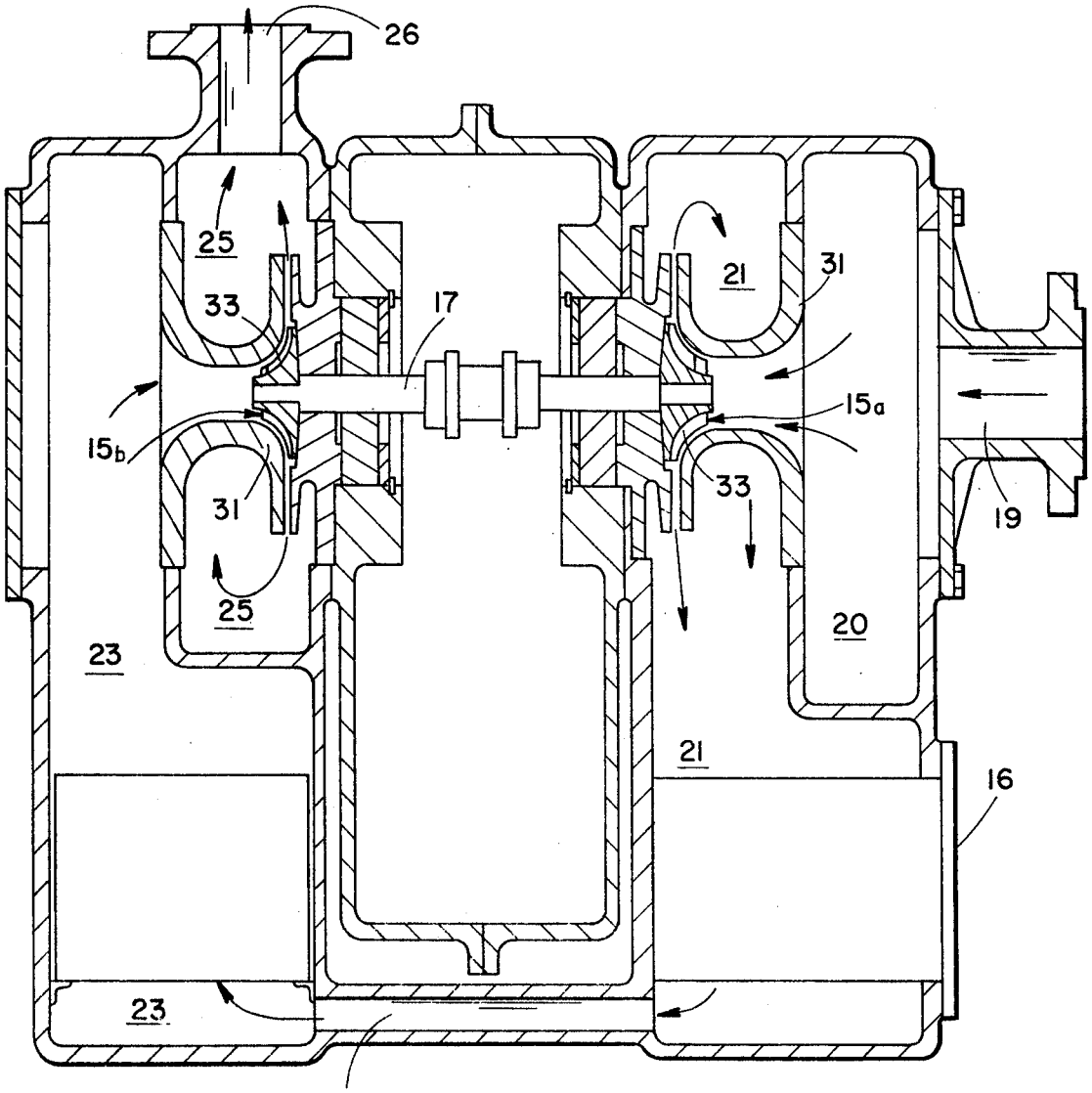
FIG. 1 is a cross-sectional view of a multistage centrifugal compressor provided with an impeller constructed in accordance with and embodying the novel features of the present invention.

As shown in the drawings for purposes of illustration, the present invention is embodied in an impeller 15 particularly adapted for use in a centrifugal compressor 16. Herein, first and second stage impellers **15*a* and 15*b* are mounted on opposite ends of a shaft 17 rotated by suitable drive means (not shown). The two impellers are of similar construction, one being right-handed and the other being left-handed, depending upon the direction of rotation of the shaft. In operation of the compressor, gas is drawn through an inlet 19 into an inlet plenum 20 and is discharged from the periphery of the first stage impeller 15*a* into a discharge plenum 21. The latter is connected to an inlet plenum 23 for the second stage impeller by way of a conduit 24 and, as the shaft rotates, gas is drawn from this plenum by the impeller 15*b* to be disharged at higher pressure into a second discharge plenum 25 communicating with an outlet 26**.

Figure 2:
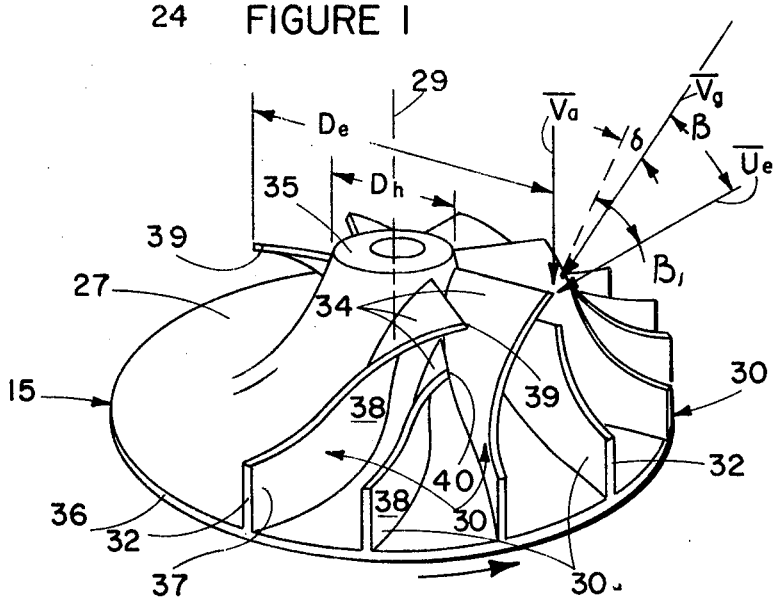
FIG. 2 is a fragmentary, perspective view of an impeller embodying the novel features of the present invention and having certain blades thereof omitted so as to more clearly illustrate the various parts of the impeller.

Because of the staging which occurs in the compressor 16, the impellers **15*a* and 15*b* actually are of different sizes and slightly different shapes based upon various design considerations of the compressor. For purposes of the following general description, however, they may be considered to be of the same general configuration, keeping in mind that they are of opposite hand. Accordingly, one of the impellers 15 is shown in FIG. 2 and includes a body 27 formed as a body of revolution having a generally frustoconical shape and whose outer surface is concave toward the rotational axis 29 thereof so as to define in axial section an arcuate contour. Integrally formed with the body and protruding from the outer surfaces thereof are a plurality of impeller blades 30. When the impeller is mounted within the compressor,the spaces between the blades and an adjacent casing 31 (see FIG. 1), complementary in shape to the axial contour of the blades, define passages 33** through which gas flows and is compressed.

More particularly, with respect to the shape of the blades 30 of the impeller 15, each blade includes an inducer section 34 which extends in a generally axial direction from adjacent the eye end 35 of the body 27 lengthwise toward the base end 36. Intermediate the eye and base ends of the body, the inducer section of the blade merges gradually into a generally radial section 37. To provide a smooth and continuous flow of gas through the impeller, the inducer sections are curved in a generally axial direction with respect to the axis 29 of the impeller so that the leading edge 39 of each inducer section is spaced circumferentially ahead of the radial section of the blade in the direction of impeller rotation (see FIG. 2). Preferably, the sections are curved in a manner such that an angle, $\beta$, as measured between a tangent to the curvature of the blade working surface 38 in the inducer section and a plane perpendicular to the impeller axis, becomes increasingly larger upon progressing from the leading edge toward the radial section. In this way, the passages 33 between adjacent blades are configured so as to change the axially directed fow of gas into the impeller to a radially directed flow out of the impeller at the radial tips 32 of the blades in a smooth and continuous manner.

While all of the impeller blades 30 are configured in the foregoing fashion, the inducer sections 34 of alternate blades are truncated. As is shown in FIG. 2, the leading edges 40 of the such blades are spaced from the eye end 35 of the impeller body 27 so as to avoid crowding at the inlet of the impeller 15 and restricting the inflow of gas to the impeller. Herein, these alternate blades are referred to as splitter vanes **30*a* and they serve to minimize undesirable recirculation of gas within the impeller between the full length blades 30**.

In designing the compressor 16 to meet specified needs certain structural limitations are imposed upon the impellers 15 to be utilized in the compressor so that it operates as efficiently as possible. Characteristically, these structural limitations involve the selection of an impeller having the proper diameter opening or eye at the inlet end thereof. In addition, for each blade 30 in the impeller, it is important that the working surface 38 at the leading edge 39 of the inducer section 34 approach the incoming axial flow of gas at a particular angle. For different compressors and for different stages in any one compressor, this inlet angle $\beta$ and the eye diameter $D_e$ are based upon the rotational speed of the compressor shaft 17. The speed, in turn, is based upon various known theoretical and empirical considerations related to the desired flow and head increase of the compressor input relative to the compressor output.

More particularly, with reference to FIG. 2, the gas velocity at the periphery of the leading edge 39 of the inducer section 34 is shown to be the vector sum of the axial velocity $\overline{V}_a$ of the gas and the peripheral velocity $\overline{U}_e$ of the gas relative to the working surface 38. These axial and peripheral velocities are given by the formulas;

$$V_a = \frac{Q}{\frac{\pi}{4}(D_e^2 - D_h^2)S} \text{ and} \tag{1}$$

$$U_e = \pi D_e N, \tag{2}$$

respectively, where, Q, rlepresents the gas flow rate; $D_e$, the eye diameter of the impeller; $D_h$, the hub diameter of the impeller, N, the rotational speed of the impeller and, S, an empirically determined solidity factor adjusting the formula (1) for the thickness of the blades.

The resulting gas velocity, $V_g$, is given by the expression, $$V_g = \sqrt{V_a^2 + U_e^2} \quad (3)$$

For the minimum gas velocity relative to the impeller, expressions (1) and (2) are substituted in equation (3) and the first derivative of the resulting expression is set equal to zero, yielding the following formula (calculus steps omitted):

$$D_e = \sqrt{100\left(\frac{Q}{NS}\right)^1 + D_h^2} \quad (4)$$

Form equation (4), the desired eye diameter, $D_e$, for a given set of conditions may be calculated easily by inserting the appropriate values of Q, N, S and D.

As mentioned previously, the inlet angle, $\beta$, at the leading edge 39 preferably is such that the resulting gas velocity, $V_g$ relative to the working surface 38 at the leading edge is minimized. From FIG. 2, it is seen that the angle, $\beta$, theoretically, is given by expression $$\beta = \tan^{-1}\frac{V_a}{V_e} \quad (5)$$

In practice, the theoretical angle, $\beta$, is increased slightly to provide a positive angle of gas incidence, $\delta$, so that work is performed upon the gas immediately as the gas enters the impeller inlet. Herein, the inlet angle, $\beta_1$, represents the theoretical inlet angle, $\beta$, plus the positive angle of incidence, $\delta$, which, characteristically, is in the neighborhood of 3°–5°.

Figure 4:
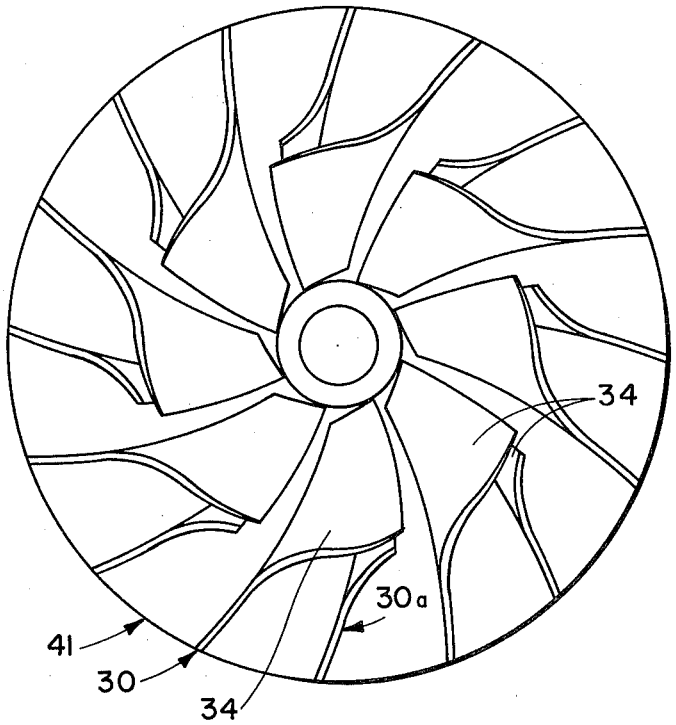
FIG. 4 is a plan view of the impeller blank taken substantially along line 4—4 in FIG. 3.

From the foregoing, it will be appreciated that the eye diameter, $D_e$, and inducer inlet angle, $\beta$, vary for different operating conditions of the impeller 15. As a result, for a family of compressors 16 capable of producing a wide range of different outputs, a series of different impellers is needed if optimum efficiency for each compressor is to be maintained. In accordance with the primary aim of the present invention, the inducer sections 34 of the blades 30 are shaped in a novel fashion to provide a universal impeller blade 41 (see FIGS. 3 and 4) which may be trimmed in a simple machining operation to provide the specific eye diameter and inlet angle needed for an impeller. For this purpose, the working surface 38 of each inducer section 34 is generated by a family of curves 43 (see FIS. 5, 6 and 7) which are stacked in a generally radial direction relative to the axis 29 of the impeller and extend lengthwise relative to such axis to generate the working surface. In particular, the curves are defined by the general formula, $$W = Kf(Z), \quad (6)$$

wherein, Z, represents the axial dimension of each curve; W, represents the transverse dimension of each curve as measured circumferentially relative to the axis of the impeller and, K, is a constant whose value varies in relation to the radial distance of each curve from the impeller axis. Advantageously, K is a tangent function related to the minimum eye diameter, $D_{min}$, for the series of impellers in the family of compressors and, additionally, K is varied in accordance with the ratio of such minimum eye diameter to the eye diameter of the impeller selected for a particular compressor within the family. By virtue of this construction, the impeller blank may be trimmed radially to the specific eye diameter, $D_e$, needed and also may be trimmed so that at the leading edge 39 the inlet angle, $\beta$, is as desired. Thus, the right and left-handed impellers needed for the family of compressors may be made from two universal blanks instead of needing a separate casting for each impeller in the series.

In the embodiment of the invention illustrated in FIGS. 1–4, the generally radial sections 37 of the impeller blades 20 are of the swept type wherein the working surfaces 38 of sections are shifted circumferentially in a direction opposite the normal direction of rotation of the impeller 15 from what otherwise would be true radial positions relative to the impeller axis 29. The radial curvature of the sweep is defined mathematically in accordance with established and well known formulas enabling the swept radial sections to be located coordinately relative to true radial positions. In substantially the same manner, swept positions relative to the basic radially directed geometry of the inducer sections 34 of the blades are computed through the use of coordinate shifting calculations to establish the swept configuration in the inducer sections so that the complete length of each blade is swept as desired.

While for some applications the swept blade configuration is preferred, unswept radial baldes may be entirely satisfactory and even desirable for other applications. In either application, however, the same basic geometry exists for the inducer sections 34 of the impeller blades 30 and this basic geometry is shown diagrammatically in FIGS. 5–7 of the drawings as incorporated in an impeller with unswept blades. It is felt that this unswept impeller presents a clearer picture of the basic inducer geometry. Accordingly, in the remaining portion of this specification, the basic inducer geometry is described in association with the unswept impeller configuration utilizing the same but primed reference numbers as the swept version and with the understanding that such description would apply equally well to the swept blade impeller configuration except for the aforementioned coordinate shifting.

Figure 6:
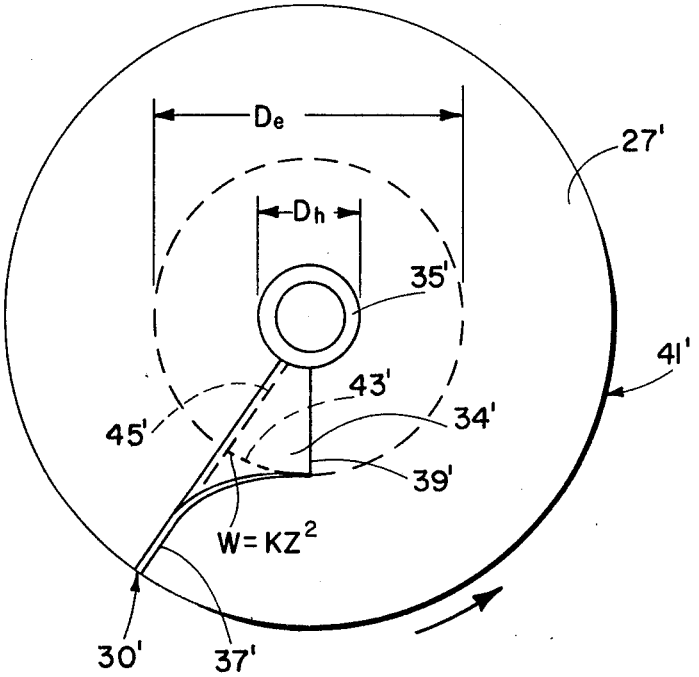
FIG. 6 is a view taken substantially along line 6—6 of FIG. 5.
Figure 5:
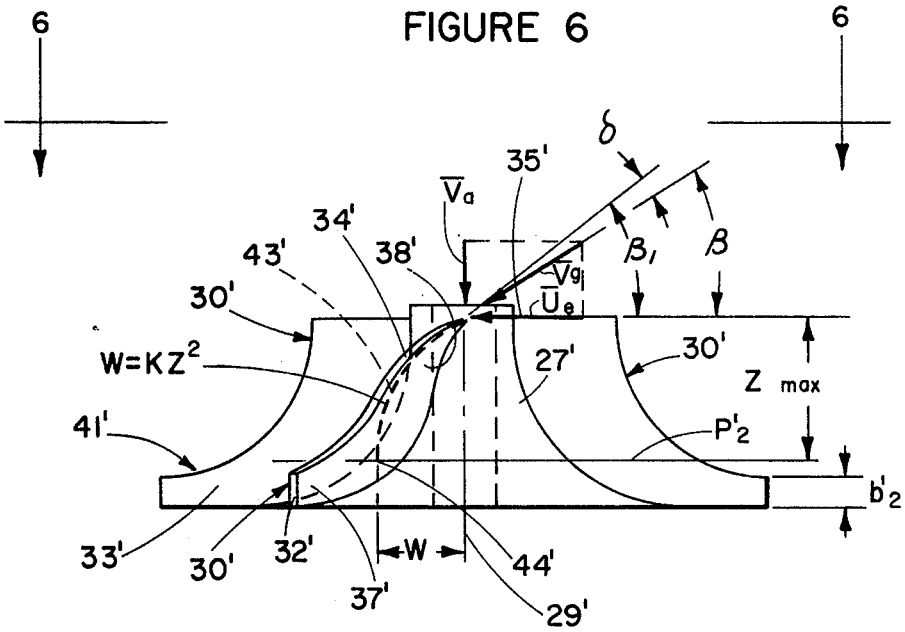
FIG. 5 is a diagrammatic side view of an alternative embodiment of the exemplary impeller blank.
Figure 7:
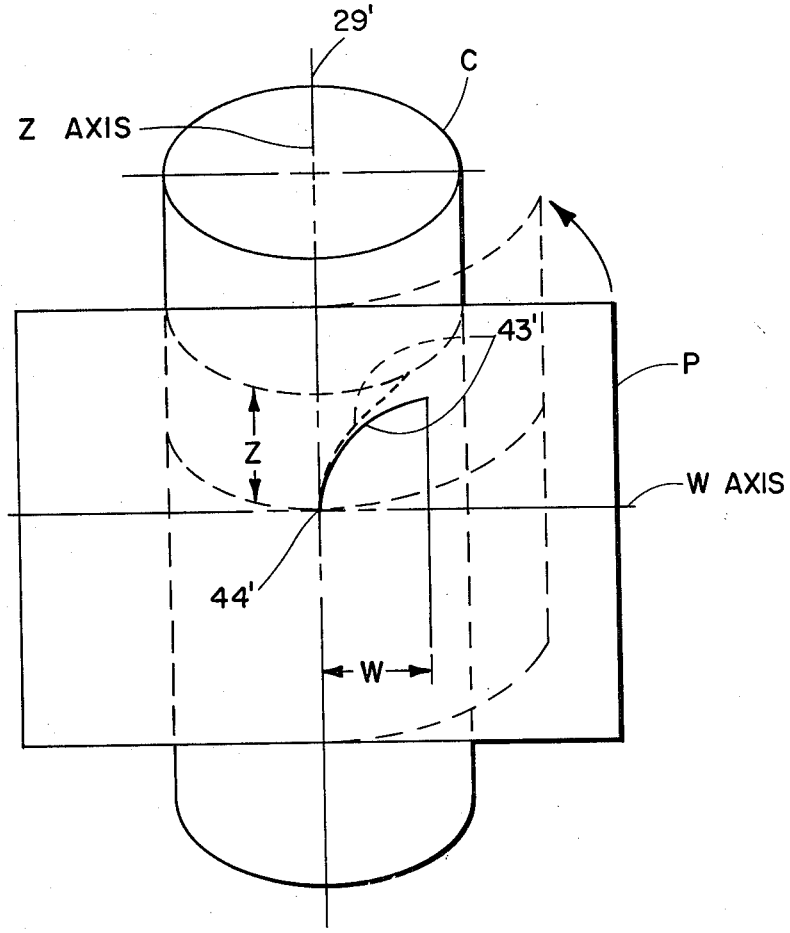
FIG. 7 is a diagrammatic, perspective view illustrating the way in which the working surface of the inducer sections is generated by means of curved lines.

Accordingly, with reference to FIGS. 5–7, the family of curves 43' generating the inducer section 34' preferably is of the general formula, $$W = KZ^2, \quad (7)$$

so that the working surface 38' is generally parabolic in shape. In generating the working surface, the curves are wrapped on cylindric surfaces concentric with the impeller axis 29'. One such curve 43' illustrating this is shown in FIG. 7 with the vertical coordinate Z axis and the horizontal coordinate W axis of the curve being located in a coordinate plane P. The dashed position of the curve represents its location on the surface of the cylinder C as the plane P is wrapped in a counterclockwise direction on the surface of the cylinder. The remaining curves in the family are wrapped in the same fashion on cylinders of different diameters, $D_e$, representing the range of diameters from minimum, $D_{min}$, to maximum, $D_{max}$, eye diameters. Herein, the origins 44' for the family of curves are located within a common plane (shown as line $P_2'$ in FIG. 5) perpendicular to the impeller axis 29' so that, at their lower ends, the curves are tangential, in an axial direction, to the generally radially extending sections 37' of the blades. Thus, the passages 33' defined between the blades 30' by the impeller body 27' and the casing 31 provide for a smooth and continuous flow of gas through the impeller.

In constructing the impeller blank 41' for the family of compressors 16, the minimum eye diameter, $D_{min}$, for an impeller 15 of the family and the maximum axial length, $Z_{max}$, of the curves 43' are selected. The eye diameteer, $D_{min}$, may be calculated in accordance with the formula (4) based upon the speed, flow and pressure capacities of the compressor in the family. The curve length, $Z_{max}$, is set empirically by establishing a suitable axial turning length for the gas flow such as by means of layouts of the series of impellers in the compressor family. With the $D_{min}$ and $Z_{max}$ limitations, the corresponding angle, $\beta_m$, also is fixed according to the previously mentioned empirical considerations and rotational speed of the impeller. Advantageously, the curve constant K is set as a tangent function of this desired $\beta_m$, so that, at $D_{min}$ and $Z_{max}$, the slope of a particular one of the curves is equal to the tangent of $\beta_m$ for that curve.

To establish the value of K mathematically, it is seen that the first derivative of equation (7) with respect to Z is, $$\frac{dW}{dZ} = 2KZ = \text{Cot}\beta.$$

Solving for K produces the equation, $$K = \frac{1}{2Z\tan\beta} \text{ and,}$$

at $D_{min}$ and $Z_{max}$, this formula becomes, $$K_m = \frac{1}{2Z_{max}\tan\beta_m}. \quad (8)$$

Because the inlet angle $\beta$ at some Z length of curve 43' for an impeller operating at a selected speed is a function of the radial distance of the curve from the impeller axis 29', then for other eye diameters, $D_e$, than the minimum eye diameter, $D_{min}$, the curve constants are given by the general formula, $$K = K_m\frac{D_e}{D_{min}} = \frac{D_e}{2D_{min}Z_{max}\tan\beta_m}. \quad (9)$$

Thus, the value of K for the other curves 43' in the family may be established for forming the working surface 38' of the inducer section 34'. Moreover, it will be appreciated that by defining the various curves in the foregoing manner, at the leading edge 39', the value of $\beta$ for any one curve in the family decreases as the axially measured length of the curve increases and additionally, upon progressing radially outward from the minimum eye diameter, $D_{min}$, the value of $\beta$ decreases in magnitude.

Utilizing the foregoing formulas, the impeller blank 41+ (typically a casting) may be made and an impeller for a specific compressor 16 may be prepared from the blank by cutting its diameter in accordance with the flow rate and speed desired for the particular compressor, and also by cutting the axial length of the impeller blades to achieve the required inlet angle $\beta$.

As an aid to further understanding of the present inducer geometry, the general form of the working surface 38' of one blade 30' of the impeller blank 41' is shown in FIG. 5 with the one of the family of curves 43' from which the working surface is generated being shown as a dashed line. In this figure, it is seen that the origin of the illustrated curve lies at the point 44' represented by the intersection of the eye diameter, $D_e$, with the horizontal plane, $P_2'$, spaced the maximum axial distance, $Z_{max}$, from the inlet end 35' of the impeller body 27'. In FIG. 6, the curve 43' appears as a dashed curved line concentric with the impeller axis 29'. As shown, the total axial length of the impeller body is somewhat greater than the axial length $Z_{max}$ plus an axial dimension, $b'_2$, which is the maximum desired length of the blade tip 32' for the series of impellers for the family of compressors 16. The origins of other curves in the family lie within the same horizontal plane as the curve that is illustrated, and along a common radial line 45'. In FIG. 5, the inducer section 34' of the blade is, of course, that portion positioned above the horizontal plane, $P_2'$, while the radial section 37' is that portion below the plane. In FIG. 6, the inducer section lies counterclockwise of the radial line 45' while the radial section is shown as an edge.

Figure 3:
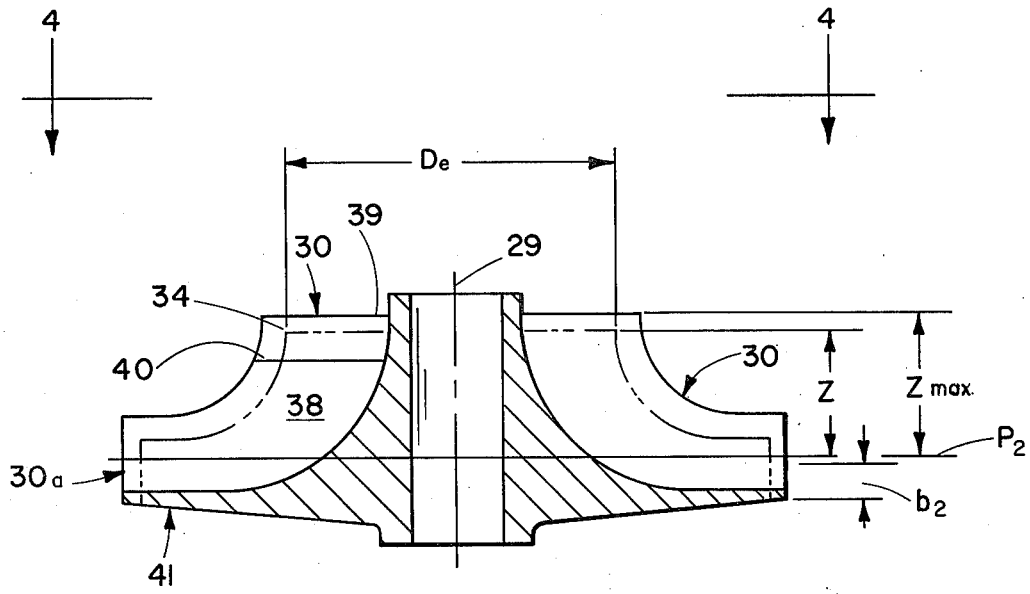
FIG. 3 is an axial section view of the impeller blank.

For the swept blade embodiment, FIG. 3 illustrates how the impeller blank 41 is cut both radially and axially to the broken line outline to achieve both the selected eye diameter, $D_e$, and the appropriate inducer blade inlet angle, $\beta$ (refer to FIG. 2). For an impeller of minimum eye diameter, $D_{min}$, the blank has the appropriate inducer blade inlet angle, $\beta_m$, but where a larger eye diameter, $D_e$, is used, the inlet angle at the full length impeller is shallower than that which is desired. Accordingly, the blank is trimmed axially to achieve the appropriate inlet angle, $\beta$. If the axial trim of the blank leaves an excessively thick inducer blade at the inlet, the blade may be thinned to improve the aerodynamic characteristics of the impeller.

Thus, it is seen from the foregoing, that the present invention brings to the art a unique universal impeller blank 41 from which a series of impellers 15 for different capacities of compressors 16 may be made by a simple machining operation so as to avoid the need of having a separate casting for each impeller in the series. Advantageously, this is achieved, in the exemplary embodiments, by generating the inducer section 34 of the impeller blades 30 from the family of parabolic curves 43 of the general formula $W = KZ^2$. In generating the inducer sections of the blades, the curves are wrapped upon cylindrical surfaces concentric with the impeller axis 29 and the curve constant, K, is varied from a minimum value in accordance with the distance of such curves from the axis. By virtue of establishing the minimum value of the curve constant as a tangent function related to the minimum eye diameter, $D_{min}$, for the axis of impellers, an appropriate inlet angle $\beta_m$ is established for the impeller having the minimum eye diameter and the other sizes of impellers for the series may be made by appropriate trimming of the blank in radial and axial directions to achieve the other eye diameters, $D_e$, and inlet angles, $\beta$, peculiar to those impellers.

I claim:

1. A centrifugal compressor impeller, comprising;

a body formed as a truncated, generally conical body of revolution with a longitudinal axis of rotation, a circular cross section transverse to said axis and an arcuate axial section;

a plurality of impeller blades on the surface of the conical body adjacent the ase thereof, each impeller blade including a generally radial section extending from an outer end at the base of the body generally toward said axis and an inducer section extending from the truncated end of the body, in a generally axial direction to mmerge smoothly with said generally radial section, each inducer section being defined by parabloic curves wrapped on a series of cylindrical surfaces concentric with the impeller axis, the origin of each parabolic curve being in a plane transverse to the impeller axis and spaced a preselected distance from the truncated end of said body.

2. The impeller of claim 1 in which at the origins of the parabolas defining an inducer blade, each parabola is tangent to a plane containing the impeller axis and extending radially therefrom.

3. The impeller of claim 2 in which the form of each parabolic curve is $$W = KZ^2 \tag{7}$$

where

W is the circumferential dimension of the parabola wrapped on one of said cylindrical surfaces;

K is the parabolic constant; and

Z is the axial dimension of the curve..

4. The impeller of claim 3 where the constant, K, for each parabola is a function of the diameter of thee cylinder for that parabola.

5. A centrifugal compressor impeller, comprising;

a body formed as a truncated, generally conical body of revolution with a longitudinal axis of rotation, a circular cross section transverse to said xis and an arcuate axial section;

a plurality of impeller blades on the surface of the conical body adjacent the base thereof, each impeller blade including a generally radial section extending from an outer end at the base of the body generally toward said axis and an inducer section extending from the truncated end of the body, in a generally axial direction to merge smoothly with said generally radial section, each inducer section being defined by parabolic curves wrapped on a series of cylindrical surfaces concentric with the impeller axis, the origin of each parabolic curve being in a first plane transverse to the impeller axis and spaced a preselected distance from the truncated end of said body and, at said origins, each parabolic curve being tangent to a second plane which contains the impeller axis and extends radially therefrom, the form of each parabolic curve being defined by the expression $$W = KZ^2 \tag{7}$$

where

W is the circumferential dimension of the parabola wrapped on one of said cylindrical surfaces;

K is the parabolic constant and, for each parabola, is a function of the diameter of the cylinder for that parabola, and Z is the axial dimension of the curve, the constant K, for each parabola being given by the expression $$K = K_m \frac{D_e}{D_{min}}$$

where $K_m$ is the constant for the parabola wrapped on a cylindrical surface of diameter $D_{min}$ K is the constant for the parabola wrapped on a cylindrical surface of diameter $D_e$.

6. The impeller of claim 5 in which the surface of each inducer section is substantially flat in a plane radial of the impeller.

7. A centrifugal compressor impeller blank from which a desired one of a series of impellers is made, said blank comprising;

a body formed as a truncated, generally conical body of revolution with a longitudinal axis, a circular section transverse to the axis and an arcuate section longitudinal of the axis;

a plurality of impeller blades on said body, each of said blades including a first section extending inwardly from the base of said body and an inducer section extending from said first section to the truncated end of the body, and said inducer section having an angle with respect to a plane transerse to said axis which is an inverse function of diameter and an inverse function of axial distance from said first section, said inducer section further being defined by curves wrapped on a series of cylindrical surfaces concentric with the impeller axis.

8. An impeller cut from the blank of claim 7, having an eye diameter defined as a function of desired flow rate and an axial length selected for an inducer section inlet angle, $\beta$, to minimize gas velocity relative to the surface of the inducer section.

9. The impeller of claim 8 in which the inducer section inlet angle, $\beta$, is given by the expression $$\beta = \tan^{-1} \frac{\text{axial gas velocity}}{\text{peripheral gas velocity}}$$

10. The impeller blank of claim 7 in which the inducer sections are defined by parabolic curves of the form $$W = KZ^2, \tag{7}$$

where

W is the circumferential dimension of inducer section around the impeller body,

Z is the axial inducer dimension from said first sections of the impeller blades and K is the parabolic constant.

11. A centrifugal compressor impeller blank from which a desired one of a series of impellers is made, said blank comprising;

a body formed as a truncated, generally conical body of revolution with a longitudinal axis, a circular section transverse to the axis and an arcuate section longitudinal of the axis;

a plurality of impeller blades on said body, each of said blades including a first section extending inwardly from the base of said body and an inducer section extending from said first section to the truncated end of the body, and said inducer section having an angle with respect to a plane transverse to said axis which is an inverse function of diameter and an inverse function of axial distance from said first section.

said inducer sections being defined by parabolic curves of the form $$W = Kz^2, \tag{7}$$

W is the circumferential dimension of inducer section around the impeller body,

Z is the axial inducer dimension from said first sections of the impeller blades and K is the parabolic constant and is a function of the impeller eye diameter, $D_e$.

12. The impeller blank of claim 11 in which the parabolic constant, K, is given by the expression $$K = \frac{D_e}{2Z_{max}D_{min}\tan\beta_m} \quad (9)$$

where $Z_{max}$ is the maximum length of the inducer sections, $D_{min}$ is the minimum eye diameter for the series of impellers, and $\beta_m$ is the inlet angle of the inducer section for maximum inducer length and minimum inducer diameter.

13. The method of making an impeller for a centrifugal compressor having an established flow rate from a universal impeller blank, comprising;

selecting the speed of rotation for the impeller, providing an universal impeller blank which has a body formed as a truncated, generally conical body of revolution with a longitudinal axis, a circular section transverse to the axis and an arcuate section longitudinal of the axis, a plurality of impeller blades on said body, each of said blades including a first section from the base of said body and an inducer section extending from said first section to the truncated end of said body, and said inducer section having an angle with respect to a plane transverse to said axis which is an inverse function of diameter and an inverse function of axial distance from said first section;

cutting the inducer sections to the eye diameter for the selected speed and established flow rate of the compressor; and cutting the length of the impeller blades for an inlet angle, $\beta$, at the tip of the inducer section with respect to a plane at right angles to the impeller axis, which is optimum for the impeller eye diameter.

14. The method of claim 13 for making an impeller in which the impeller eye diameter is established for minimum fluid velocity with respect to the impeller.

15. The method of making an impeller for a centrifugal compressor having an established flow rate, comprising;

selecting the speed of rotation for the impeller, providing an impeller blank which has a body formed as a truncated, generally conical body of revolution with a longitudinal axis, a circular section transverse to the axis and an arcuate section longitudinal of the axis, a plurality of impeller blades on said body, each of said blades including a first section from the base of said body and an inducer section extending from said first section to the truncated end of said body, an said inducer section having an angle with respect to a plane transverse to said axis which is an inverse function of diameter and an inverse function of axial distance from said first section;

cutting the inducer sections to the eye diameter, $D_e$, for the selected speed and established flow rate of the compressor; and cutting the length of the impeller blades for an inlet angle, $\beta$m, at the tip of the inducer section with respect to a plane at right angles to the impeller axis, which is optimum for the impeller eye diameter, $D_e$, being established for minimum fluid velocity with respect to the impeller in accordance with the expression $$D_e = \sqrt{100\left(\frac{Q}{NS}\right)^1 + D_h^2}, \quad (4)$$

where

Q is the rate of gas flow at the eye of the impeller,

N is the impeller speed, $\beta$,

S is the factor which is a function of the blade thickness, and, $D_h$ is the impeller hub diameter at the truncated end.

16. The method of claim 13 for making an impeller in which the length of the impeller is cut to establish the inducer section inlet angle, $\beta$, for minimum gas velocity relative to the surface of the inducer section.

17. The method of claim 16 for making an impeller in which the inducer section inlet angle, $\beta$, is given by the expression $$\beta = \tan^{-1}\frac{\text{axial gas velocity}}{\text{peripheral gas velocity}}$$

18. A universal impeller blank from which a series of impellers may be formed with different eye diameters, $D_e$, and inlet angles, $\beta$, said blank comprising a body formed as a body of revolution about a central axis and having a generaly frustoconical shape with an upper end portion, a base portion and a curved outer surface concave generally toward said central axis, a plurality of impeller blades integrally formed with and protruding from said body, each of said blades including a generally radial section and an inducer section, said radial section extending lengthwise in a generally radial direction and edgewise in a generally axial direction along the base portion of said body, said inducer section extending lengthwise from said radial section in a generally axial direction and edgewise in a generally radial direction along the upper portion of said body, and said inducer section having a working surface generated by a family of at least second order curves having the general formula $$W = Kf(Z), \quad (6)$$

where

W is the circumferential dimension of the curve relative to the axis of the impeller, Z is the axial dimension of the curve, K is a curve constant, and $f(Z)$ represents a function of Z said constant, K, having a value which is a tangent function related to the maximum axial length, $Z_{max}$ of said curves and the minimum eye diameter, $D_{min}$ for the impellers in the series, the value of K also being variable according to the ratio of the radius of said minimum eye diameter to the radial distance of said curve from the axis of said impeller so that the blades of the impeller blank may be trimmed in axial and radial directions to produce a selected impeller of the series.

19. A universal impeller blank as defined in claim 18 where $$f(Z) = Z^2.$$

20. A universal impeller blank as defined in claim 19 wherein the value of the curve constant, K, is given by the formula:

$$K = \frac{D_e}{2D_{min}Z_{max}\tan\beta_m}, \quad (9)$$

where $\beta_m$ is the theoretical inlet angle for an impeller within the series having the minimum eye diameter, $D_{min}$, and maximum curve length $Z_{max}$.

21. A universal impeller blank from which a series of impellers may be formed with different eye diameters, $D_e$, and inlet angles, $\beta$, said blank comprising a body formed as a body of revolution about an axis, a plurality of blades integrally formed with said body and protruding therefrom, said blades each having a working surface with at least a portion thereof extending lengthwise in a generally axial direction and edgewise in a generally radial direction relative to said axis, and with said portion being generated by a family of at least second order curves wrapped on cylinders corresponding to the eye diameters, $D_e$, and whose slopes increase upon progressing away from the eye of the impeller, said curves being defined by the general formula $$W = Kf(Z), \quad (6)$$

where

W is the circumferential dimension of the curve relative to the axis of the impeller, Z is the axial dimension of the curve, K is a curve constant, and $f(Z)$ represents a function of Z, said curve constant, K, having a value given by the formula, $$K = \frac{D_e}{D_{min}f'(Z)_{max}\tan\beta_m},$$

where $D_{min}$ is the minimum eye diameter for the impellers in the series, and $f'(Z)_{max}$ is the value of the first derivative of (6) for the maximum axial dimension, $Z_{max}$, of the curves for the impellers in the series, and $\beta_m$ is the theoretical inlet angle for an impeller within the series having the minimum eye diameter, $D_{min}$, and maximum axial curve length, $Z_{max}$.

22. A centrifugal compressor impeller, comprising;

a body formed as a truncated, generaly conical body of revolution with a longitudinal axis of rotation, a circular cross section transverse to said axis and an arcuate axial section;

a plurality of impeller blades on the surface of the conical body adjacent the base thereof, each impeller blade including a generally radial section extending from an outer end at the base of the body generally toward said axis and an inducer section extending from the truncated end of the body, in a generally axial direction to merge smoothly with said generally radial section, each inducer section being defined by curves wrapped on a series of cylindrical surfaces concentric with the impeller axis, the origin of each curve being in a first plane transverse to the impeller axis and spaced a preselected distance from the truncated end of said body and, at said origins, each curve being generally tangent to a second plane which contains the impeller axis and extends radially therefrom, the form of each curve being defined by the expression $$W = Kf(Z) \quad (7)$$

where

W is the circumferential dimension of the curve wrapped on one of said cylindrical surfaces;

Z is the axial dimension of the curve, $f(Z)$ represents the curve function of Z, and K is the curve constant and, for each curve is a function of the diameter of the cylinder for that curve, and for each curve is given by the expression $$K = K_m \frac{D_e}{D_{min}}$$

where $K_m$ is the constant for the curve wrapped on a cylindrical surface of diameter $D_{min}$ K is the constant for the curve wrapped on a cylindrical surface of diameter $D_e$.

* * * * *

UNITED STATES PATENT AND TRADEMARK OFFICE

CERTIFICATE OF CORRECTION

PATENT NO. : 4,093,401

DATED : June 6, 1978

INVENTOR(S) : Homer E. Gravelle

It is certified that error appears in the above-identified patent and that said Letters Patent are hereby corrected as shown below:

In Claim 1, at Line 7 of Column 8 in the printed patent, delete "ase" and insert --base--.
In Claim 1, at Line 2 of Column 9 of the printed patent, delete "mmerge" and insert --merge--.
In Claim 1, at Line 4 of Column 9 of the printed patent, delete "parabloic" and insert --parabolic--.
In Claim 4, at Line 2 of Column 9 of the printed patent, delete "thee" and insert --the--.
In Claim 5, at Line 4 of Column 9 of the printed patent, delete "xis" and insert --axis--.
In Claim 7, at Line 14 of Column 10 of the printed patent, delete "transerse" and insert --transverse--.
In Claim 11, "$W = Kz^2$," should read --$W = KZ^2$, where--
In Claim 13, at Line 5 of Column 11 of the printed patent, delete "an" and insert --a--.
In Claim 15, at Line 14 of Column 12 of the printed patent, delete "$\beta$ ,".
In Claim 15, at Line 5 of Column 12 of the printed patent, "$\beta m$, should read --$\beta$, --.

Signed and Sealed this

*Fifth* Day of *December 1978*

[SEAL]

*Attest:*

RUTH C. MASON
*Attesting Officer*

DONALD W. BANNER
*Commissioner of Patents and Trademarks*